United States Patent [19]

Gray

[11] 4,222,570

[45] Sep. 16, 1980

[54] SIMULATED RADAR GAME

[76] Inventor: Patrick M. Gray, 4934 Cleves Pike, Cincinnati, Ohio 45238

[21] Appl. No.: 921,788

[22] Filed: Jul. 3, 1978

[51] Int. Cl.[3] ..... A63F 3/00; A63F 7/22

[52] U.S. Cl. ..... 273/237; 273/265

[58] Field of Search ..... 273/1 G, 1 T, 85 G, 273/85 R, 237, 238, DIG. 28; 38/10.4

[56] References Cited

U.S. PATENT DOCUMENTS

| | | | |
|---|---|---|---|
| 3,127,174 | 3/1964 | Ryan | 273/1 E |
| 3,473,808 | 10/1969 | Parker | 273/238 |
| 3,537,708 | 11/1970 | Carr | 273/238 |
| 3,645,529 | 2/1972 | Andrews | 273/1 E |
| 4,019,745 | 4/1977 | Mustelier | 273/237 |
| 4,085,524 | 4/1978 | Meyer | 35/10.4 |

FOREIGN PATENT DOCUMENTS

| | | | |
|---|---|---|---|
| 747794 | 12/1966 | Canada | 273/1 E |
| 1395757 | 3/1965 | France | 273/237 |
| 725556 | 11/1966 | Italy | 273/237 |

*Primary Examiner*—Richard C. Pinkham
*Assistant Examiner*—Scott L. Brown
*Attorney, Agent, or Firm*—Frost & Jacobs

[57] ABSTRACT

A simulated radar game having a radar-like display screen with an illuminated circular rotating scanning line. A first set of programming switches may be used to establish one or more target positions on the screen corresponding to selected angular and radial positions with visual indication occurring each time a selected position is passed over by the scanning line. A second set of programming switches may be used to establish reference coordinates corresponding to desired angular and radial reference positions. Coincidence between a target position and a reference position causes a scoring indication.

10 Claims, 6 Drawing Figures

SIMULATED RADAR GAME

BACKGROUND OF THE INVENTION

1. Field of the Invention

The present invention relates generally to matching games, and more particularly to a matching game employing a radar-like display screen.

2. Description of the Prior Art

Various types of matching games are known wherein one player creates a particular game strategy, and an opposing player attempts to duplicate or predict the game strategy in a minimum number of operations. A classic example of this type of game is "Battleships" wherein one player positions various ships on a coordinately arranged target field, with the opposing player attempting to "sink" the ships by deducing the coordinate positions which are concealed from the opposing player. In fact, such games have been provided with electrical and electronic devices to make them more interesting, such as those games described in U.S. Pat. No. 3,376,041 issued Apr. 2, 1968, to F. P. Anderson, U.S. Pat. No. 3,531,114 issued Sept. 29, 1972, to L. Parks, et al. and U.S. Pat. No. 3,537,708 issued Nov. 3, 1970, to M. J. Carr.

In games of this type, a matching position is generally found by chance, or through a series of logical moves deduced by suggestions made by the opposing player. This usually requires that the game board of each player is advantageously hiddem from the other's view, with each move being mentally visualized. Heretofore no provision has been made for providing a visual display which indicates the opposing player's strategy or moves.

SUMMARY OF THE INVENTION

While the simulated radar game of the present invention is directed primarily for use as a matching-type game, it will become apparent from the description to follow that the apparatus may be employed in other entertaining ways as well. It is contemplated that the simulated radar game apparatus and the associated methods for playing the game will find application not only in a self-contained game device, but also in arcade and video games.

In general, the radar game comprises a radar-like display screen with an illuminated rotating circularly scanning line. The display screen includes an overlay having a grid-like coordinate matrix for identifying target positions. A first set of programming switches is used to establish one or more target positions on the screen corresponding to selected angular and radial positions. A visual indication occurs each time a selected position is passed over by the scanning line. A second set of programming switches may be used to establish reference coordinates corresponding to desired angular and radial reference positions. When the apparatus is employed as a matching-type game, coincidence between a target position and a reference position causes a scoring indication.

The simulated radar game is housed in a box-like enclosure having oppositely arranged, back-to-back control panels for use by opposing players. The control panel for a first player includes a plurality of angular position switches for establishing the angular coordinates of one or more targets. Also included are a plurality of radial distance position switches for establishing the radial distance of at least one target. By activiating selected ones of this first set of angular and radial position programming switches, the first player may program the position of a simulated target at a desired location.

Positioned proximate the position switches is a metallic grid-like coordinate matrix bearing legends depicting the angular and radial distance positions available at the position switches. One or more magnetic markers in the shape of a toy aircraft or other simulated target may be positioned on the matrix to direct attention to the radial and angular positions programmed by the first player.

On the opposite side of the radar game enclosure, corresponding to the position occupied by the second player, is a vertical panel mounting a second set of angular position switches and radial distance position programming switches similar in configuration and function to those located on the opposite side of the enclosure. When a target programmed with the second set of switches matches that programmed by the first set of switches, an audible or visual alarm is activated. To further enhance the realism of the simulated radar game, the enclosure also contains a sloped panel located above the switch panel in the form of a radar display.

The display comprises a colored translucent screen bearing an overlay containing a grid-like coordinate matrix in the form of a plurality of concentric circles designating radial distance from a zero distance point at the center of the screen, and lines extending outwardly at equal angles from the zero distance point designating angular position.

Underlying the translucent screen is a disc-like support plate rotatable about a fixed axis positioned beneath the zero distance point of the screen. The support plate is rotatable at a fixed rate by means of an electric motor attached to a shaft co-axial with the fixed axis of the support plate. The support plate mounts a linear light source facing the screen and extending radially outwardly from the zero distance point. The linear light source, when rotated about the zero distance point by the rotating plate, thus appears to produce an illuminated scanning line on the screen suggestive of a radar screen display. Provision may also be made so that an audible or visual indication occurs each time the scanning line completes a revolution.

The support plate also mounts a plurality of spaced point light sources extending radially outwardly from the zero distance point adjacent the linear light source and corresponding to each discrete radial distance. A point light source will become illuminated each time the scanning line passes over a radial and angular position corresponding to a target programmed by the first player by means of the first set of angular and radial position programming switches. Thus, for example, if the first player has selected a target at a distance of forty miles and an angular position of 315°, the point light source corresponding to this position will become illuminated each time the scanning line passes over that position.

Electrical power is supplied to the linear and point light sources mounted on the support plate by means of a rotatable slip ring assembly positioned adjacent the rearmost surface of the support plate. The slip ring assembly comprises a plurality of concentric circular conducting surfaces affixed to a stationary support plate underlying the rotatable support plate and centered on the zero distance point. Electrically conducting brushes attached to the rearmost surface of the rotatable support plate which are free to slide on an associated circular conducting surface and make electrical contact therewith provide current paths to the point light sources and linear light source. The upper surface of the stationary support plate also contains a plurality of conductive areas spaced equidistant from the fixed axis at angular positions corresponding to the discrete angular distances. An electrically conducting brush attached to the rearmost surface of the rotatable support plate is free to slide on the surface of the stationary support plate and make successive electrical contact with each of the conductive plate areas as the rotatable support plate is rotated, thus producing electrical signals indicative of the angular position of the plate. A supplemental contact is connected to an audible or visual indicating device mounted on the rotatable support plate which provides an output for each revolution of the plate. These conducting surfaces may be fabricated by printed circuit technology or the like.

The location of the conducting surfaces and areas of the plate in association with the two sets of programming switches provide a coincidence detection circuit which produces a signal when the set of target coordinates selected by the first player is equivalent to the reference position established by the second player to produce an alarm or scoring indication. In addition, the coincidence detection circuit causes one or more of the point light sources to become illuminated when the scanning line passes over the corresponding angular and radial distance position, thereby producing a realistic radar-like display.

The specific operation of the game apparatus, and exemplary ways of using the apparatus will be described in more detail hereinafter.

BRIEF DESCRIPTION OF THE DRAWINGS

FIG. 6 is a schematic diagram of the simulated radar game of the present invention.

DESCRIPTION OF THE PREFERRED EMBODIMENTS

Figure 1:
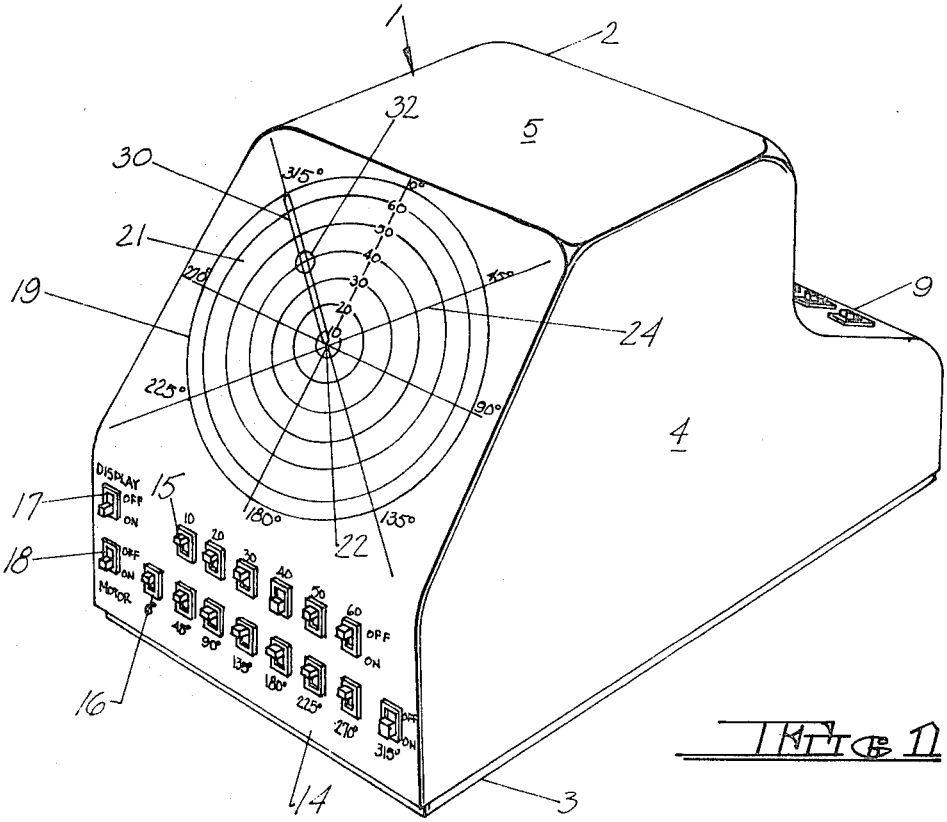
FIG. 1 is a perspective view of the simulated radar game of the present invention.
Figure 3:
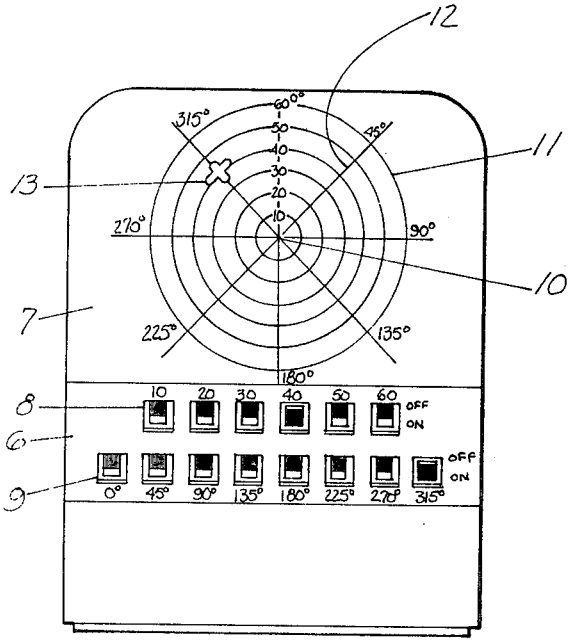
FIG. 3 is a rear elevation view of the simulated radar game of the present invention.

The radar game, shown generally at 1 in FIG. 1, comprises a box-like enclosure 2 having a substantially flat base 3, a pair of spaced vertical side walls 4, and a substantially flat horizontal top 5. As can best be seen in FIG. 3, enclosure 2 includes a first control station for use by a first player comprising a control panel 6 spaced above base 3 and sloping upwardly and rearwardly, and a vertically disposed gridlike coordinate matrix overlay 7 extending between the upper edge of control panel 6 and top 5.

Control panel 6 contains an upper horizontal row of six radial distance switches, one of which is shown at 8, for establishing the radial distance of at least one target. Each switch 8 comprises a switch having an activated (on) position, and a deactivated (off) position. For purposes of an exemplary showing, radial distance switches 8 have been designated "10", "20", "30", "40", "50" and "60", corresponding to the equivalent number of miles from a zero distance reference point, as will be explained in more detail hereinafter. Control panel 6 also contains a second horizontal row of angular position switches, one of which is shown at 9, positioned beneath radial distance switches 8, for establishing the angular coordinates of one or more targets. Each of angular position switches 9 also comprises a switch having an activated (on) position and a deactivated (off) position. Angular position switches 9 have been designated "0°", "45°", "90°", "135°", "180°", "225°", "270°", and "315°", corresponding to increments of 45° between successive angular positions. It will be understood, however, that from the description of switches 8 and 9, and from the description to follow, that any number of suitably arranged radial distance and angular position switches may be employed. Switches 8 and 9 may be slide, toggle, or any other type of suitable switch.

Coordinate matrix 7 preferably comprises a metallic plate bearing legends depicting the angular and radial distance positions available at radial distance and angular positions programming switches 8 and 9. The legends displayed on coordinate matrix 7 include a zero distance point 10 centered at the approximate center of the matrix, and a plurality of six concentric circles, one of which is shown at 11, radiating outwardly from zero distance point 10. Each of concentric circles 11 designates a radial distance from zero distance point 10, and is labeled with a radial distance corresponding to one of the radial distances of programming switches 8. For example, the concentric circle designated "10" corresponds to a radial distance of ten miles and to radial distance switch 8 labeled "10". Matrix 7 also includes eight equally spaced angular position lines, one of which is shown at 12, radiating outwardly from zero distance point 10. Lines 12 identify, in increments of 45°, the angular positions corresponding to angular position switches 9.

In order to direct attention to the radial and angular positions programmed by the first player, one or more magnetic markers in the shape of a toy aircraft or other simulated target, such as that illustrated at 13, may be positioned on matrix 7. For example, in the example illustrated in FIG. 3, a radial distance has been selected by means of switch 8 at forty miles, and an angular position has been selected by means of switch 9 at 315°. Thus marker 13 is positioned at these corresponding coordinates on matrix 7.

Figure 2:
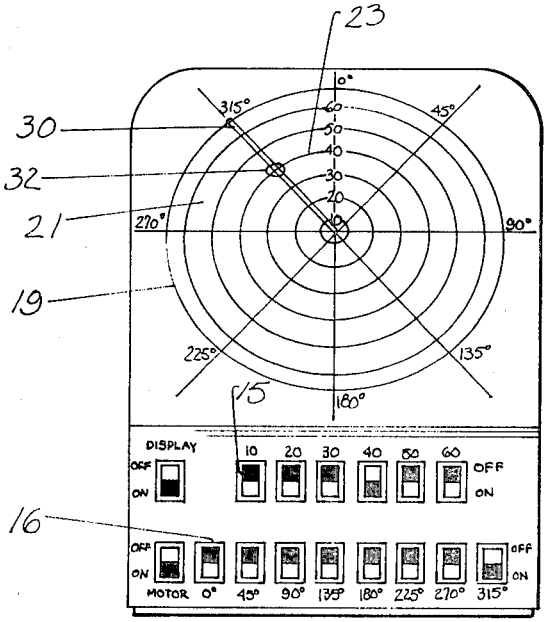
FIG. 2 is a front elevation view of the simulated radar game of the present invention.

On the opposite side of enclosure 2, corresponding to the position occupied by the second player, as is best shown in FIG. 1 and FIG. 2, is a vertical control panel 14 extending upwardly from base 3 mounting a second set of programming switches similar in configuration to those located on control panel 6. This set of programming switches comprises a first horizontal row of radial distance switches, one of which is shown at 15 for establishing a reference radial distance for at least one target. Control panel 14 also includes a second row of angular position programming switches, one of which is shown at 16, positioned beneath switches 15, for establishing the angular position of one or more reference targets. Each of switches 15 and 16 is of the slide variety and contains an activated and deactivated position.

Also included on control panel 14 is a slide switch 17 designated "Display" positioned approximately in line with radial distance switches 15, for controlling the illuminated display, and a switch 18 designated "Motor", positioned approximately in line with angular position switches 16, for controlling the scanning motor, both of these functions being described in more detail hereinafter.

Positioned immediately above control panel 14, and sloping rearwardly and upwardly toward enclosure top 5, is a radar-like display screen 19. Screen 19 comprises a thin circular colored, clear or diffused, transparent or translucent sheet 19 of plastic, glass, or other optically transmissive material, supported by the sloping surface of enclosure 2, and bearing, either integrally or affixed thereto, an overlay 21 having a grid-like coordinate matrix for identifying target positions. Overlay 21, which is similar in design to matrix 7, comprises a zero distance point 22 located approximately at the center of overlay 21, and a plurality of circular concentric lines, one of which is indicated at 23, equally spaced and radiating outwardly from zero distance point 22. Each concentric circle 23 bears a designation "10", "20", "30", "40", "50", or "60", indicating the radial distance from zero distance point 22. Each of these distances corresponds to a particular one of radial distance switches 15. Overlay 21 also includes a plurality of equally spaced radial lines, one of which is shown at 24, extending outwardly from zero distance point 22 corresponding to the angular positions designated by angular position programming switches 16. It will be understood that there is one radial distance programming switch 8 and 15 corresponding to each of radial distance lines 23, and one angular position programming switch 9 and 16 corresponding to each of angular distance lines 24. For purposes of an exemplary showing, radial distance lines 23 have been designated in increments of ten miles from zero distance point 22, while angular position lines 24 have been designated in increments of 45° measured clockwise from a line extending radially outwardly from zero distance point 22.

Spaced beneath and parallel to translucent screen 20 is a disc-like support plate 25 rotatable about a fixed axis 26 extending perpendicularly to support plate 25 through zero distance point 22 of screen 20. A shaft 27 is non-rotatably attached to support plate 25 coaxial with fixed axis 26. Support plate 25 is rotatable at a fixed rate about axis 26 by means of electric motor 28 attached to shaft 27. Motor 28 may be supported within enclosure 2 by any convenient means, not shown. For purposes of an exemplary showing, the direction of rotation of motor 28 has been chosen so as to rotate support plate 25 in a clockwise direction as viewed from above, i.e. in the direction of increasing angular distance as represented by angular distance lines 24.

A linear light source 29 producing a thin elongated illuminated line is affixed to the upper surface of support plate 25 facing the underside of screen 20, and extending radially outwardly from zero distance point 22 to beyond the outermost or "60" mile radial distance line. This linear light source, when rotated about zero distance point 20 by the rotation of plate 25, thus appears to produce an illuminated scanning line 30 on display screen 19 suggestive of a radar screen display.

Positioned adjacent and parellel to linear light source 29 are a plurality of spaced point light sources, one of which is shown at 31, such that a linear light source is positioned directly beneath and corresponds to one of the circular concentric radial distance position lines 23. As will be explained in more detail hereinafter, one or more point light sources will become illuminated to produce a small illuminated area or "blip" 32 each time scanning line 30 passes over a radial and angular position corresponding to a target programmed by the first player by means of angular and radial position programming switches 8 and 9, respectively. Thus, for example, if the first player has selected a target at a distance of forty miles and an angular position of 315° as illustrated by the exemplary settings of switches 8 and 9 in FIG. 3, the point light source corresponding to this position (i.e. the point light source 31 underlying radial position line 40) will become illuminated each time the scanning line 30 passes over that position as shown in FIG. 1 and FIG. 2.

Figure 4:
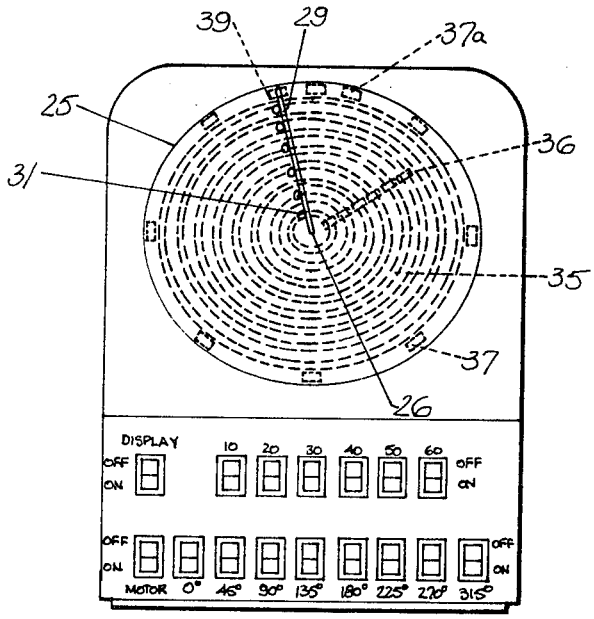
FIG. 4 is a front elevation view, partially cut away, of the simulated radar game of the present invention.
Figure 5:
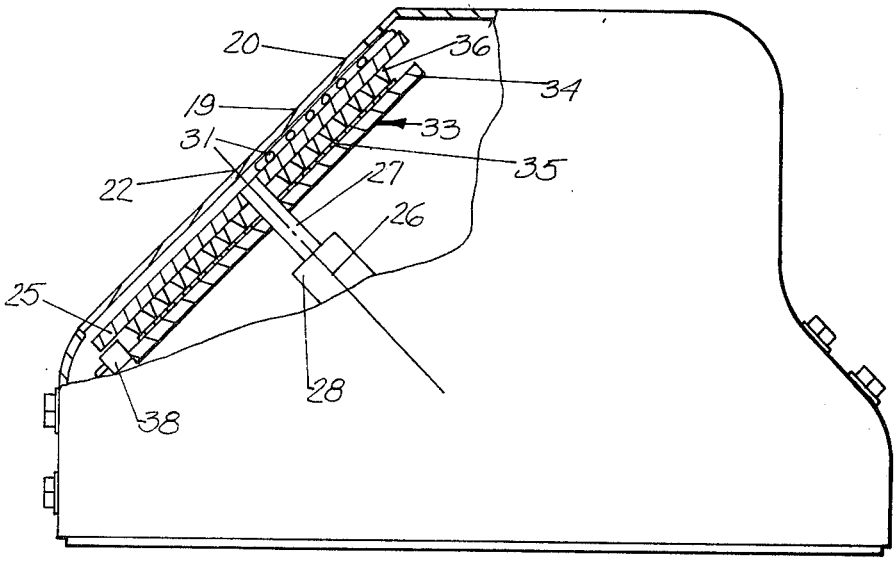
FIG. 5 is a side elevation view partially cut away and partially in cross section, of the simulated radar game of the present invention.
Figure 3:
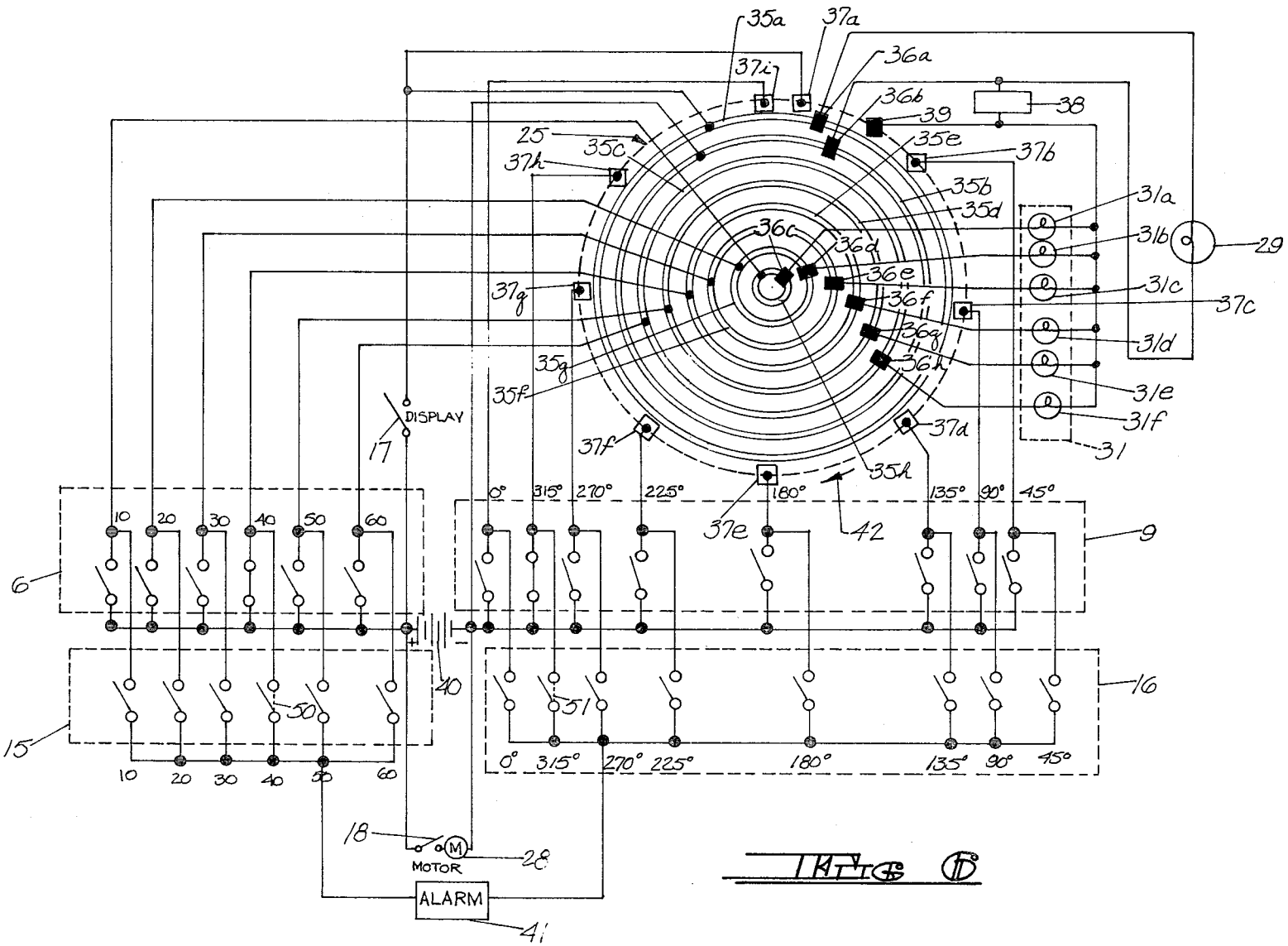

Electrical power may be supplied to linear light source 29 and point light sources 31 mounted on support plate 25 by means of a slip ring assembly, shown generally at 33 in FIG. 5, positioned adjacent the rearmost surface of support plate 25. As shown in FIG. 4 and FIG. 5, slip ring assembly 33 comprises a stationary support plate 34 parallel to and spaced from the rearmost surface of rotatable support plate 25. Stationary support plate 34 bears eight concentric circular conducting surfaces, one of which is illustrated at 35, centered on fixed axis 26. As will be described in more detail hereinafter, six of circular conducting surfaces 35 supply electric power to point source light sources 31, while the remaining two circular conducting surfaces supply electric power to linear light source 29.

Attached to the rearmost surface of rotatable support plate 25 and overlying each of circular conducting surfaces 35 is an electrically conducting brush, one of which is shown at 36, which is free to ride on an associated conducting surface and make electrical contact therewith. It will thus be observed that a continuous electrical path may be provided through brushes 36 and concentric conducting surfaces 35 as rotatable support plate 25 is rotated.

Attached to the outer circumference of stationary support plate 34 are nine spaced conducting areas or pads, one of which is shown at 37, which form part of the coincidence detecting circuit by producing electrical signals indicative of the angular positions of rotatable support plate 25 as will be explained in more detail hereinafter. Eight of conducting areas 37 are positioned at 45° intervals beginning at a point corresponding to the 0° angular position line 24. The ninth conducting area, illustrated at **37*a*, supplies position information to an audible or visual indicating device 38 mounted on rotatable support plate 25 which produces an output for each revolution of the plate. As illustrated in FIG. 5, indicating device 38 may be positioned near the peripheral edge of rotatable support plate 25, and will normally be configured to produce an output when scanning line 30** passes over the 0° angular position line.

A single electrically conducting auxiliary brush 39 is attached to the rearmost surface of rotatable support plate 25 so as to make successive electrical contact with each of conducting areas 37 and **37*a* as plate 45** rotates. The various conducting surfaces may be fabricated as printed circuits, as desired.

The electrical circuit for the radar game is illustrated in FIG. 6. One terminal of a source of power, such as battery 40, is connected to a pole of each of angular position programming switches 9, to one terminal of electric motor 28, and to circular conducting surface **35*b*. The other terminal of battery 40 is connected to one pole of each of radial distance programming switches 6, through Display switch 17 to circular conducting surface 35***a*, and through Motor switch 18 to the remaining terminal of motor 28.

One pole of each of angular position programming switches 16 is connected to one terminal of scoring alarm 41, while one terminal of each of radial distance programming switches 15 is connected to the remaining terminal of alarm 41. The normally open terminal of "10" mile radial distance programming switches 6 and 15 are connected to circular conducting surface 35*h*. The normally open poles of "20" mile switches are connected to circular conducting surface 35*g*. In a similar manner, the normally open poles of radial distance programming switches "30", "40", "50" and "60", are connected to circular conducting surfaces 35*f*, 35*e*, 35*d* and 35*c*, respectively.

In a similar manner, the normally open poles of angular position programming switches 9 and 16 corresponding to "0°", "45°", "90°", "135°", "180°", "225°", "270°", and "315°", are connected, respectively, to conducting pads 37*i*, 37*b*, 37*c*, 37*d*, 37*e*, 37*f*, 37*g*, and 37*h*.

Turning to components mounted on rotatable support plate 25, one terminal of linear light source 29 is connected to brush 36*a* associated with circular conducting surface 35*a*, while the other terminal of linear light source 29 is connected to brush 36*b* associated with circular conducting surface 35*b*. In a similar manner, one terminal of each of point light sources 31*a*–31*f* is connected to auxiliary brush 39, while the remaining terminal of each of these point light sources is connected to brush 36*c*–36*h*, respectively. Indicator 38, which provides a visual or audible indication of each revolution of scanning line 30, is connected between auxiliary brush 39 and brush 36*b*.

In operation, motor 28 is activated by closing Motor switch 18 to initiate rotation of rotatable support plate 25 in the direction indicated by arrow 42. In addition, linear light source 29 may be illuminated by closing Display switch 17 which supplies power from battery 40 through conducting surface-brush pairs 35*a*–36*a*, and 35*b*–36*b*. It will further be observed that a continuous negative voltage is supplied to one terminal of indicator 38, and that a continuous positive voltage is supplied to supplemental conducting area 37*a*. As auxiliary brush 39 passes over conducting area 37*a*, a current path will be created through indicator 38 to provide a visual or audible indication for each revolution of rotatable support plate 25. It is generally preferred that the indication occur when scanning line 30 passes over the 0° angular position line.

As described hereinabove, a point light source 31 will become illuminated each time scanning line 30 passes over a radial and angular position corresponding to a target programmed by the first player by means of the first set of angular and radial position programming switches 6 and 9. This operation is illustrated for a particular exemplary setting of the switches in FIG. 6, where only the "40" mile and 315° switches are in the closed or activated position. In this condition, a positive voltage will be supplied through circular conducting surface 35*e* and brush 36*f* to a terminal of point light source 31*d*. Likewise, a negative voltage will be supplied to conducting pad 37*h*. Thus, when auxiliary brush 39 connected to the other terminal of point light source 31*d* passes over pad 37*h* (which is associated with an angular position of 315°) light source 31*d* will become illuminated for a short period of time. This will produce a small illuminated area or "blip" 32 on display screen 19 substantially coextensive with scanning line 30 at a radial position of 40 miles and an angular position of 315°, thus indicating the presence of a target. In a similar manner, other targets may be programmed to appear on screen 19 at different positions by activating the desired radial distance switches 6 and angular position switches 9.

It will be observed that with radial distance switches 15 and angular position switches 16 in the normally opened or unactivated (off) position, no voltage will be supplied to activate scoring alarm 41. However, when a switch 15 and a switch 16 corresponding to an associated switch 6 and switch 9, respectively, are activated, alarm 41 will be activated. For example, as illustrated in FIG. 6, when the "40" mile switch associated with radial distance programming switch 15 is moved to the closed position indicated by dashed line 50, and the 315° switch associated with angular position switch 16 is moved to the closed position indicated by dashed line 51, a potential difference will exist across scoring alarm 41 to provide an indication that the reference position matches the target position. It will be understood that this procedure may be utilized for each target position that has been programmed.

In an examplary method of playing the simulated radar game, the first player activates radial distance programming switch 6 corresponding to "60" miles and an angular position programming switch, such as 45°. The display and motor are activated by means of switches 17 and 18, respectively, which causes the scanning line 30 to begin rotating about zero distance point 22. The first player may also position magnetic marker 13 at the appropriate position of sixty miles and 45° on matrix 7, as a further reminder of the location of the target.

The second player, observing the display screen, notes that a "blip" occurs at a radial distance of sixty miles and an angular position of 45°, and attempts to "destroy" the simulated target by activating the 60 mile and 45° switches on his control panel 14. If the target programmed by the first player has not moved, a match will occur as described hereinabove, causing a scoring indication from alarm 41 and indicating that the target has been "destroyed". However, in the meantime, the first player may move the simulated target one coordinate position, that is either a radial distance of ten miles or an angular distance of 45° to avoid the target being destroyed by the second player. This chase will continue until either the second player accurately predicts the position of the target to cause a scoring indication, or the target reaches the zero distance point. It will thus be observed that whereas in prior art matching games the second player must rely solely on guess work or verbal suggestions from the opposing player, the present game provides a dynamically changing indication of the target position by means of the simulated radar screen.

In another exemplary application for playing the simulated radar game of the present invention, the first player selects one or more target positions by means of switches 6 and 9 to represent buildings, storms, mountains or other obstructions, while the second player attempts to navigate a predetermined course and avoid these obstructions either by watching the radar-like display screen or by way of vocal instructions from the first player watching the screen. The realism of this embodiment of the game may be enhanced by providing an overlay for the display screen representing an arial map of a particular geographic location, such as the United States.

While the present invention has been illustrated and described in terms of a preferred electrical embodiment, it will be understood that the apparatus and methods described herein find equal applicability to games of the arcade and video types as well. It will be further understood that various changes in the details, materials, steps and arrangements of parts, which have been hereindescribed and illustrated in order to explain the nature of the invention, may be made by those skilled in the art within the principle and scope of the invention as expressed in the appended claims.

The embodiments of the invention in which an exclusive property or privilege is claimed are as follows:

1. A simulated radar game comprising:

a. a visually sensible display screen comprising an optically transmissive sheet having a zero distance point, each point on said screen corresponding to a distance coordinate measured radially outwardly from said zero distance point and an angular coordinate corresponding to an angular distance measured from a line extending radially from said zero distance point;

b. scanning means for producing on said display screen a scanning line comprising a linear light source facing said screen and extending radially outwardly from and continuously rotating about a fixed axis extending through said zero distance point for producing an illuminated scanning line;

c. first programming means located remotely from said screen for establishing at least one target position corresponding to a selected angular and radial coordinate on said screen;

d. second programming means located remotely from said screen for establishing at least one set of reference coordinates corresponding to a selected angular and radial position on said screen;

e. coincident detection means located remotely from said screen for producing a signal when said set of reference coordinates is equivalent to said coordinates represented by said target position; and f. alarm means providing an indication when said coincident detection means signal is present.

2. The radar game according to claim 1 including means for producing on said screen a visual indication at said target position when said scanning line passes over said coordinates of said target position.

3. The radar game according to claim 1 including motor means for rotating said linear light source about said axis.

4. The radar game according to claim 1 wherein said first programming means includes a plurality of spaced point light sources extending radially outwardly from said axis adjacent said linear light source, one or more of said spaced light sources becoming illuminated as said scanning line passes over a corresponding target position.

5. The radar game according to claim 1 wherein said first programming means comprises a first set of switches for establishing said selected angular position coordinate and a second set of switches for establishing said selected radial position coordinate, and said second programming means comprises a third set of switches for establishing said reference angular position coordinate and a fourth set of switches for establishing said reference radial position coordinate, each of said switches of said first and third sets of switches corresponding to a discrete angular coordinate, each of said switches of said second and fourth sets of switches corresponding to a discrete radial coordinate.

6. The radar game according to claim 1 including indicating means for providing an indication for each revolution of said scanning line.

7. The radar game according to claim 1 including a second visually sensible display screen for providing an indication of the position of said target position.

8. The radar game according to claim 1 including a box-like enclosure housing said game, said enclosure including a sloping panel-like wall mounting said display screen.

9. A simulated radar game comprising:

a. an optically transmissive display screen having a zero distance point establishing the approximate center of said screen, a set of distance coordinates extending radially outwardly from said zero distance point, and a set of angular coordinates positioned at discrete angular distances around said zero distance point;

b. a disc-like support plate rotatable about a fixed axis extending through said zero distance point of said screen;

c. slip rings means adjacent said rotatable support plate, said slip ring means comprising a stationary support plate having a plurality of circular concentric conducting surfaces spaced outwardly from said fixed axis corresponding to said radial distance coordinates, and a plurality of conductive pad-like areas spaced equidistant from said fixed axis at angular positions corresponding to said discrete angular distances, a plurality of electrically conducting brushes secured to said rotatable support plate, each of said brushes being free to slide on and make continuous electrical contact with a corresponding one of said concentric conducting surfaces, and an electrically conducting auxiliary brush secured to said rotatable support plate, said auxiliary brush being free to slide on the surface of said stationary plate and make successive electrical contact with each of said conductive pad-like areas as said rotatable support plate is rotated;

d. motor means for rotating said rotatable support plate about said fixed axis;

e. a linear light source secured to said rotatable support plate and facing said screen, said linear light source extending radially outwardly from said fixed axis for producing an illuminated rotating scanning line, said linear light source being connected between a pair of said plurality of electrically conducting brushes;

f. a plurality of spaced point light sources mounted on said rotatable support plate and extending outwardly adjacent said linear light source, each of said point light sources having an input and an output terminal, each of said inputs being connected to a corresponding one of said plurality of brushes, said outputs being connected to said auxiliary brush;

g. a plurality of programming switches having an input and an output, said input being connected to said output when said switch is in an activated position, said input being disconnected from said output when said switch is in a deactivated position, said plurality of programming switches comprising:

i. a first set of target angle programming switches for establishing and associated with the angular position of at least one target on said screen, the inputs of said target angle programming switches being connected together, the output of each target angle programming switch being connected to a corresponding one of said conductive pad-like areas;

ii. a first set of target distance programming switches for establishing and associated with the distance position of at least one target on said screen, the inputs of said target angle programming switches being connected together, the output of each target distance programming switch being connected to a corresponding one of said concentric conducting surfaces;

iii. a second set of target angle programming switches for predicting the angular position of a target on said screen, the inputs of said second target angle programming switches being connected together, the output of each of said second set of target angle programming switching being connected to a corresponding one of said conductive pad-like areas; and iv. a second set of target distance switches for predicting the radial distance of a target on said screen, the inputs of said second set of target distance switches being connected together, the outputs of each of said second set of target distance switches being connected to a corresponding one of said concentric conducting surfaces; and h. indicating means connected between the inputs of said second set of target distance switches and the inputs of said second set of target angle switches, whereby the corresponding one of said spaced point light sources may be illuminated when said scanning line passes over the screen position associated with said target angle and distance coordinate, and said indicating means will be activated when the corresponding switch in each of said first and second sets of target angle and target distance switches is activated.

10. The radar game according to claim 9 including indicating means connected between said auxiliary brush and said point light source outputs for providing an indication for each revolution of said scan line.

* * * * *